United States Patent [19]

Weber

[11] Patent Number: 4,913,415

[45] Date of Patent: Apr. 3, 1990

[54] SHEET AND SHEET STACK DELIVERING APPARATUS

[75] Inventor: Friedrich Weber, Brensbach, Fed. Rep. of Germany

[73] Assignee: Maschinenfabrik Goebel GmbH, Darmstadt, Fed. Rep. of Germany

[21] Appl. No.: 327,030

[22] Filed: Mar. 22, 1989

[30] Foreign Application Priority Data

Mar. 22, 1988 [DE] Fed. Rep. of Germany ..... 3809588

[51] Int. Cl.[4] ..... B65H 5/02

[52] U.S. Cl. ..... 271/272; 271/270; 271/202; 198/461; 198/570; 198/623

[58] Field of Search ..... 271/202, 203, 270, 272; 198/461, 570, 623; 414/790.7

[56] References Cited

U.S. PATENT DOCUMENTS

| | | | |
|---|---|---|---|
| 2,820,633 | 1/1958 | Caulfield | 271/202 |
| 2,880,998 | 4/1959 | Middleton et al. | 271/272 |
| 3,336,028 | 8/1967 | Schonmeier | 271/202 |
| 4,230,218 | 10/1980 | Kunzmann | 198/461 |
| 4,346,881 | 8/1982 | Frye | 271/202 |
| 4,577,746 | 3/1986 | Tokund et al. | 271/202 X |
| 4,585,227 | 4/1986 | Muller | 198/461 X |
| 4,585,432 | 4/1986 | Marysse | 271/270 X |
| 4,610,593 | 9/1986 | Voss et al. | 414/790.7 |

FOREIGN PATENT DOCUMENTS

| | | | |
|---|---|---|---|
| 1031322 | 6/1954 | Fed. Rep. of Germany . | |
| 1179453 | 10/1964 | Fed. Rep. of Germany | 271/202 |
| 1461211 | 12/1968 | Fed. Rep. of Germany . | |
| 2141340 | 2/1973 | Fed. Rep. of Germany | 271/202 |
| 857851 | 1/1961 | United Kingdom . | |

*Primary Examiner*—Joseph J. Rolla
*Assistant Examiner*—Boris Milef
*Attorney, Agent, or Firm*—Watson, Cole, Grindle & Watson

[57] ABSTRACT

A sheet stack delivering apparatus has first and second pairs of opposing tape conveyors, the first pair moving at a faster rate of travel compared to that of the second pair, and the tapes of each pair being selectively pressed against one another for effecting delivery of sheet stacks at the faster or slower rates of travel of the first and second pairs of tapes.

3 Claims, 3 Drawing Sheets

SHEET AND SHEET STACK DELIVERING APPARATUS

BACKGROUND OF THE INVENTION

This invention relates to an apparatus for delivering a succession of sheets from a sheet cutting device which cross cuts a web into sheets, the web being of paper, foil, fabric, metal, synthetics or similar materials. The sheets are delivered to a sheet collecting cylinder at which stacks of sheets are temporarily collected and formed into a stack which is then deposited to a sheet stack depository station at a rate of travel less than the rate of delivery of sheets to the collecting cylinder. Delivery is effected by opposing conveyor tapes.

German published patent application DE-OS No. 14 61 211 discloses an apparatus of this general type in which sheets formed by cross cutting a web are delivered toward a sheet collecting cylinder as the sheets pass between a pair of conveyors moving at a fast rate of speed. The sheet collecting cylinder collects a plurality of sheets to form a sheet stack. Another pair of opposing conveyors downstream of the collecting cylinder is provided for delivering the stack moving between them to a stack depository. Such another pair of conveyors initially move at a rate of speed equal to the rate of travel of the conveyors upstream of the collecting cylinder when taking over the stack. Thereafter the downstream conveyors are decelerated to about 1/10th of their former speed. Once the stack is deposited, the downstream conveyors are accelerated in order to take over another stack of sheets. Therefore, not only the downstream conveyors but their guide rollers as well must be decelerated and accelerated. Because of the mass of the rollers inertia forces arise when decelerating and accelerating. Moreover, the downstream conveyors are designed to slip during acceleration and deceleration relative to their guide rollers. These inertia forces which develop are unwieldy requiring additional power and power control. And, the sheet stacks are difficult to control when being delivered to the depository.

German patent DE-AS No. 10 31 322 discloses another related apparatus in which the sheet stacks to be deposited are decelerated in such a manner that the trailing end of each stack is gripped by clamping jaws located between opposed conveyor tapes which move at a relatively high speed. The gripped stack is accordingly slowed down such that the speed of the stack to be deposited is abruptly changed. The individual sheets of the stack can therefore shift relative to one another making it difficult to properly deposit all the sheets of the stack. Also, gripping by the clamping jaws can effect undesirable marks on the sheets. And, the opposed conveyor tapes located downstream of the collecting cylinder are disposed within a pair of hinged covers which must open against the force of a spring whenever the sheet stack moves at the reduced speed. This creates inertia forces of undesirable magnitude and limits the operating speed of the apparatus.

British Pat. No. 857,871 discloses yet another related apparatus in which sheet stacks overlap one another as they are successively fed on top of preceeding sheets. A sheet stack is delivered by slowly rotating rollers intermediate opposing pairs of conveyor tapes for decelerating the stacks when delivered to the depository. Since deceleration is effected by these rollers, undesired markings on the sheets to be deposited easily occur. Moreover, the sheets of a sheet stack can easily slide relative to one another, which is undesirable. And, the individual sheet stacks slide relative to each other when they reach the depository, such that the deposit of a squared-off stack is not assured.

SUMMARY OF THE INVENTION

It is therefore an object of the present invention to provide a sheet and sheet stack delivering apparatus in such a manner that during deceleration of the sheet stacks no abrupt change of speed occurs in the speed of the sheets or in the sheet guide rollers and their drives such that any inertia forces which may develop are kept as low as possible.

The apparatus according to the invention has first and second pairs of opposing upper and lower conveyor tapes downstream of the collecting cylinder, with the first and second pairs of tapes having substantially equal horizontal stack delivery paths. The first pair of tapes moves faster than the second pair for delivering sheet stacks at selective speeds moving between the tapes of the pairs from the collecting cylinder to a depository. Pivotable cam discs associated with the first and second pairs of tapes are provided for selectively pressing together the tapes of the first pair and the tapes of the second pair to effect delivery of the stacks at the selected faster or slower speeds of the tape pairs.

The fast and slow moving tape conveyor pairs can have different periods of contact when pressed together for delivering the sheet stacks. Their conveyor rollers defining the horizontal stack delivery paths are mounted between side walls of the apparatus frame for rotation about fixed axes for the entire operating interval of the apparatus. The conveyor tape pairs can be pressed together by the pivotable cam discs at least during part of the delivery path. These discs are mounted between the side walls of the apparatus for pivotal movement about fixed axes, and can be operated to effect combinations of fast and slow delivery of the sheet stacks for delivery of non-squared off stacks which may be arc shaped or S shaped so that the sheet stack is deposited as a fan fold.

Thus, the sheets or sheet stacks to be deposited can be optionally delivered at relatively high as well as relatively low speeds. When changing from one speed to another, there is only the smallest possible movement of mass which movement is not, moreover, required at high tape conveyor speeds but can be kept low. Moreover, pivoting of the cam discs is distributed over a relatively long interval which can also be used to brake the sheets. During the braking process, the sheet stacks are not skewed. Instead they move out of the tape conveyor pair as separate sheet stacks and therefore need not be overlapped but can be deposited on top of one another at the depository. And, a relatively high ratio of relatively fast and relatively slow speeds of the sheet or sheet bundles is effected. This ratio need not be restricted to 1:2 but can be any other ratio such as, for example, 1:5 or 1:10. The relatively high speed can be quite high so as to accommodate fast processing speeds of modern machines and can even exceed such speeds. Thus, with the present apparatus the deposit of sheets does not limit the operating speed of the machine.

DETAILED DESCRIPTION OF THE INVENTION

Figure 1:
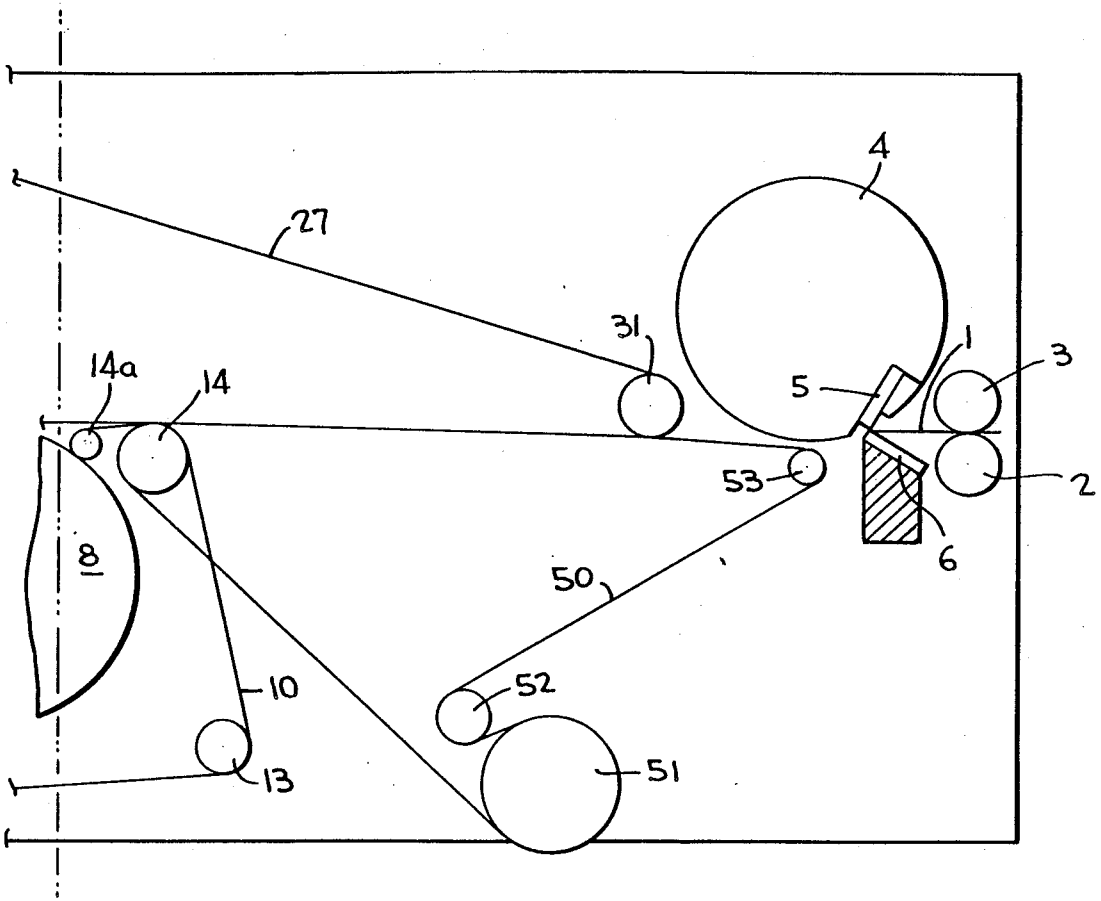
FIG. 1 is a side elevational and schematic view of part of the apparatus according to the invention.

The apparatus of the invention is schematically illustrated in the drawings, and omitted from the drawings for the sake of clarity are machine parts which are not essential to the understanding of the invention but which are sufficiently well known to those in this art.

A web 1 of paper, foil, fabric, metal, synthetic or similar material is conveyed as in any normal manner as by conveyor rollers 2 and 3 through a cross cutter device. Such device may comprise a rotatable cylinder 4 having an attached cross cutting blade 5 cooperating with a fixed lower cross cutting blade 6. Of course, any other known cross cutting device can be used without departing from the invention, such as a device having a lower rotatable cylinder with a cross cutting blade 6 cooperating with blade 5.

The web is cut into individual sheets 7 after moving through the cross cutter and are successively conveyed by moving between opposed tape conveyors toward a sheet collecting cylinder 8 rotatably journaled between side walls F of the apparatus frame. The cylinder has a plurality of concentric grooves 8*a* formed in its outer periphery (see FIG. 3) for the reception of tongues 9 pivotally mounted on the frame for movement in to and out of these grooves in a manner known in the art. Thus, sheets 7 arriving from the cross cutter can either be fed to the collecting cylinder as the tongues are pivoted upwardly for forming a sheet stack, or can bypass cylinder 8 upon downwardly pivoting the tongues into grooves 8*a*. A plurality of laterally spaced apart tape conveyors 10 are partially wrapped about cylinder 8 along sections of the cylinder between its grooves 8*a*, and tapes 10 are likewise guided about rollers 11, 12, 13, 14 and 14*a*, so that when tongues 9 are moved out of grooves 8*a*, the sheets are collected as they pass between cylinder 8 and tapes 10 which are wrapped about the cylinder, as in the normal manner.

Figure 2:
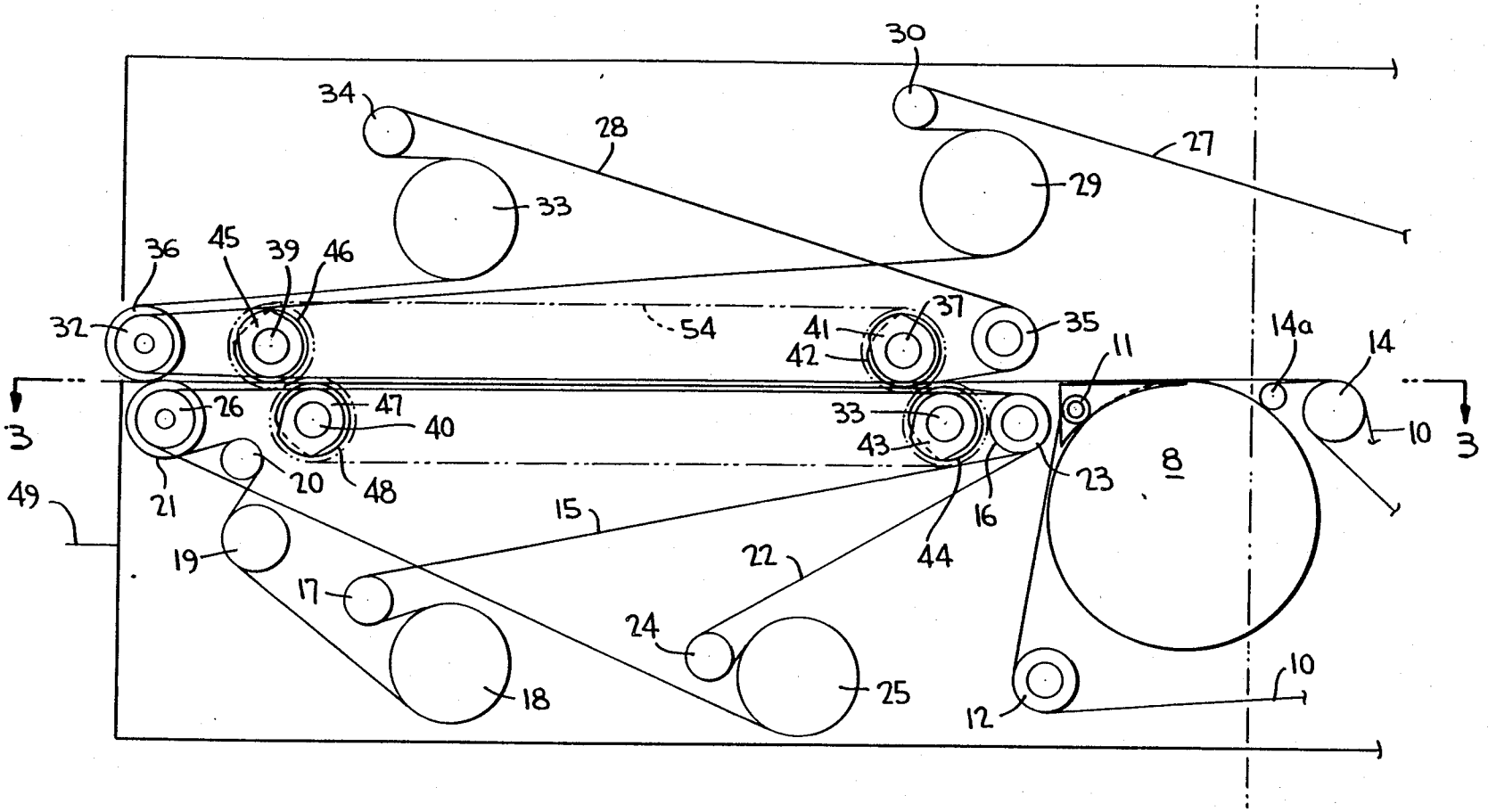
FIG. 2 is a view similar to FIG. 1 of the remaining part of the apparatus according to the invention likewise illustrating the sheet collecting cylinder of FIG. 1.
Figure 3:
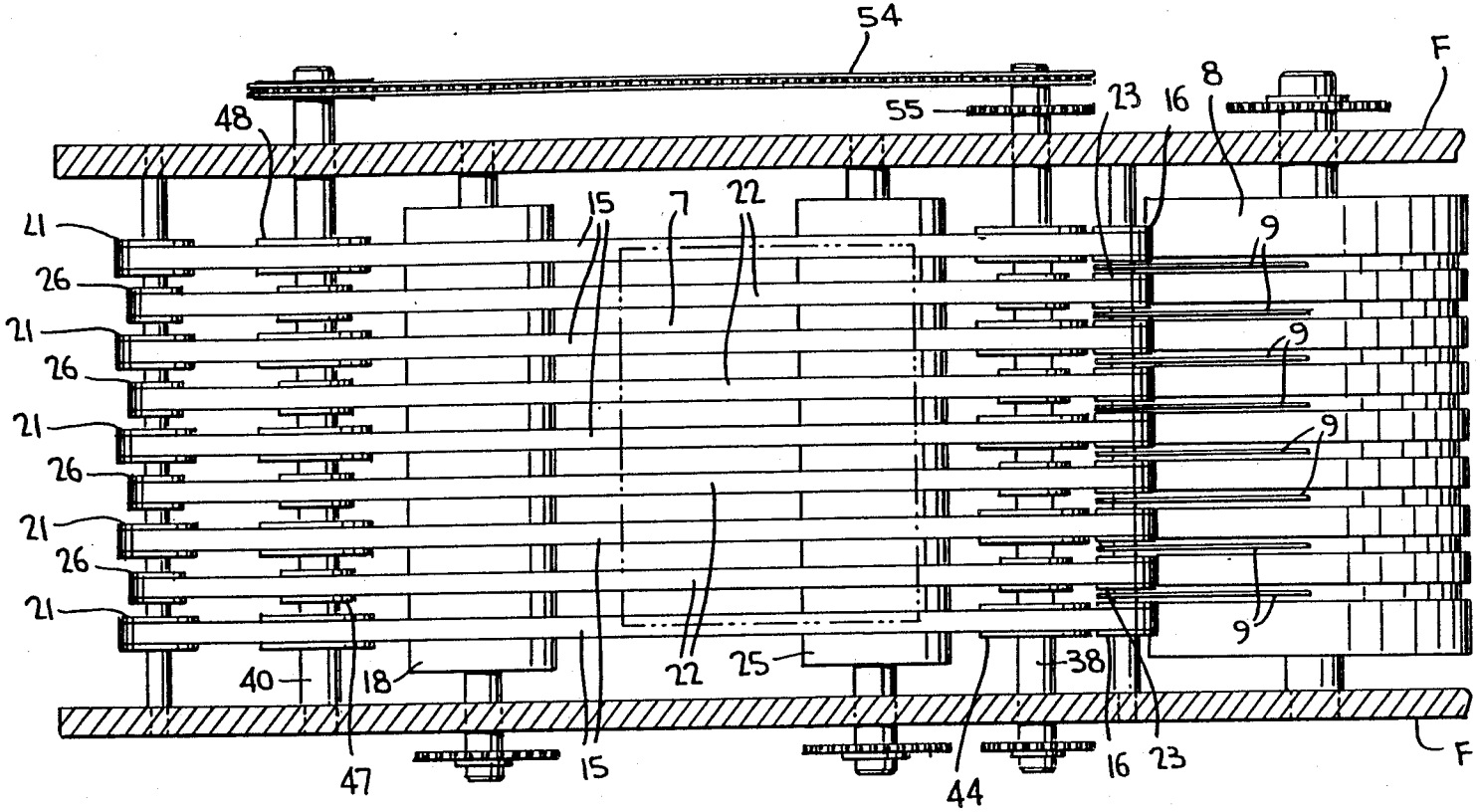
FIG. 3 is a plan view, partly in section, taken substantially along the line 3—3 of FIG. 2.

All the conveyor tapes illustrated in FIGS. 1 and 2 represent a plurality of laterally spaced apart tapes of which only one is visible in FIGS. 1 and 2 although several are visible in FIG. 3.

Conveyor tapes 10 will be referred to as lower tapes since they are located below the path of the sheets or sheet stacks to be deposited.

Laterally spaced apart conveyor tapes 15, operating at a relatively slow speed and defining lower tapes, are provided downstream of collecting cylinder 8. Tapes 15 are wound about guide rollers 16–21, the rollers being journaled between the side walls of the apparatus frame for rotation about fixed axes.

And, laterally spaced apart conveyor tapes 22 are provided for movement at a relative speed which is faster than the rate of travel of tapes 15. Conveyor tapes 22 are wound about guide rollers 23–26, and are likewise considered lower tapes. As shown in FIG. 3, conveyor tapes 15 are interdigitated with conveyor tapes 22, and guide rollers 16 alternate with guide rollers 23 on the same roller shaft, and have the same diameter. Guide rollers 25 and 18 are driven respectively at relatively high and low speeds.

Above the path of sheets or sheet stacks to be deposited are a plurality of transversely spaced apart upper, fast moving tape conveyors 27, and a plurality of transversely spaced apart upper, relatively slower moving tape conveyors 28 which are interdigitated with tapes 27. Tape conveyors 27 are wound about guide rollers 29–32, and tape conveyors 28 are wound about guide rollers 33–36. Guide roller 29 is driven at the same relatively fast speed as lower guide roller 25 so that upper and lower fast moving tape conveyors 27 and 22 travel at the same speed. And, guide roller 33 is driven at the same relatively slower speed as lower guide roller 18 so that upper tape conveyors 28 are driven at the same relatively slower speed as lower tape conveyors 15.

Upper and lower tape conveyors 27 and 22 oppose one another, and upper and lower slower moving tape conveyors 28 and 15 likewise oppose one another for delivering paper stacks moving between the respective pairs of opposing tape conveyors from collecting cylinder 8 to a depository 49. The two pairs of opposing tape conveyors define horizontal stack delivery paths each having a fixed length of travel which are substantially equal to one another. Thus, guide rollers 16, 23, 35 at the downstream end of such horizontal paths are journaled between side walls F of the apparatus frame for rotation about fixed axes. And, guide rollers 21, 26, 32, 36 at the downstream end of these horizontal paths are journaled between side walls F of the frame for rotation about fixed axes. Guide roller 31 is similarly journaled between side walls F for rotation about a fixed axis as well. The opposing tapes of the two pairs of tape conveyors are selectively pressed together to effect delivery of the sheet stacks at the faster speed of travel of tapes 27 and 22 or at the relatively slower speed of travel of tapes 28 and 15. And, the tape pair 28, 22 is interdigitated with the opposing tape pair 27, 15 with the interdigitated tapes being laterally spaced apart as shown in FIG. 3.

Shafts 37–40 are mounted inwardly of the end guide rollers of the tapes defining their horizontal paths, these shafts being journaled between side walls F of the apparatus frame for pivotal movement about their respective axes which are fixed. First and second cam discs 41 and 42 are mounted on shaft 37, these cam discs being respectively associated with slow and fast moving tape conveyors 28 and 27. Cam discs 41 and 42 are alternately mounted on shaft 37, and disk 41 has an arcuate extent of 90° while disk 42 is complementary thereto having an arcuate extent of 270°. In such manner the cam pair complement each other for a full circle of 360°. Thus, upon pivotal movement of shaft 37, externally of the apparatus by some suitable means (not shown), first cam discs 41 are pivoted into engagement with upper fast moving tapes 27 for pressing them downwardly into engagement with the opposing lower fast moving tapes 22. Similarly, upon turning movement of shaft 37 cam discs 42 press against the relatively slower moving upper tapes 28. Since cam discs 41 and 42 are mounted on the same shaft 37, are opposite one another and are phase shifted, only one of the two cam discs is operational upon pivotal movement of shaft 37 about its central axis. Thus, depending on the angle at which shaft 37 is pivoted, either the upper fast moving tape conveyors 27 or the slower moving tapes 28 are diverted from their originally prescribed course in the direction of the moving sheet stack.

Similarly, first and second cam discs 43 and 44 are mounted on a shaft 38, alternately therealong as shown in FIG. 3, the shaft being journaled between side walls F of the frame for pivotal movement about its fixed axis. Shaft 38 is gear coupled as at 55 to shaft 37 having a similar gear wheel such that cam discs 43 associated with tapes 22 are pivoted together with pivotal movement of cam discs 41 but in the opposite rotational direction. And, cam discs 44, associated with tape conveyors 15, are pivoted together with cam discs 42 but in the opposite rotational direction. The radial shifting of the first and second cam discs is sufficiently high so that in the process of pivoting, which defines the lift, the respective tape conveyors are diverted from their paths transcribed if there were no cam discs provided. The operation of the cam disc pairs functions to selectively press together the tapes of the first pair 27, 22 and the tapes of the second pair 28, 15 to effect the delivery of the sheet stacks at the speed of either the faster moving tapes or at the speed of the slower moving tapes.

Near the downstream end of the horizontal path along which the sheet stacks travel, are upper and lower shafts 39 and 40 each journaled between side frames F of the apparatus frame for pivotal movement about their respective fixed axes. The shafts are gear coupled together for pivotal movement about their axes together with the pivotal movement of shafts 37 and 38 via an interconnecting drive belt 54. First and second cam discs 45 and 46 are alternately mounted on shaft 39, and first and second cam discs 47 and 48 are alternately mounted on shaft 40. First cam discs 41, 43, 45 and 47 are the same and are mounted on their respective shafts such that they can be jointly pivoted with equal swing angles. Discs 45 and 47 are associated with the faster moving tapes 27 and 22, and discs 46 and 48 are associated with the slower moving tapes 28 and 15. The angles through which shafts 37–40 are pivoted are the same as governed by the intermeshed gears on the shafts and the interconnecting belt 54. And, second cam discs 42, 44, 46 and 48 are the same and can be pivoted through the same angle.

Guide rollers 32 for the fast moving tape conveyors 27 have a smaller diameter compared to guide rollers 36 provided for the slower moving tape conveyors 28. Similarly, the diameter of guide rollers 26 for the faster moving tapes 22 are smaller than guide rollers 21 for the slower moving tapes 15 (see also FIG. 3). This assures that sheets or sheet stacks arriving between the oposing tape conveyors exit the conveyors at slow speed or, optionally, exit the conveyors at a faster speed without, so to speak, applying brakes.

As shown in FIG. 2, shafts 37 and 38 are staggered relative to one another such that the central axis of shaft 38 lies closer to the central axis of cylinder 8 as compared to that of the central axis of shaft 37. Similarly, shafts 39 and 40 are staggered relative to one another such that the central axis of shaft 40 lies closer to the central axis of cylinder 8 compared to that of the central axis of shaft 39. With this arrangement of the shafts, on which the cam discs are mounted for pivotal movement together therewith, and the size of the selected swing angle, first cam discs 41, 43, 45 and 47 can be pressed against the faster moving upper tape conveyors 27 or against the slower moving lower tape conveyors 22 while these tapes are only negligibly diverted from their track, which is in effect prescribed by guide rollers 31, 36, 16 and 21. In such manner a sheet or sheet stack can be clamped between the fast moving upper and lower tape conveyors and rapidly conveyed to depository 49. However, by correspondingly slewing shafts 37–40, the fast moving tapes can be released from the pressure exerted by first cam discs 41, 43, 45 and 47 and instead the tapes of the upper and lower slower moving tapes can be pressed against the sheet stacks by the second cam discs 42, 44, 46 and 48. If, moreover, slewing occurs in a specific temporal relationship to the arrival of the sheets, it is possible with a corresponding adjustment of tongues 9 to collect, for example, 4 sheets on collecting cylinder 8 and to combine these 4 sheets appropriately with a following fifth sheet between the faster moving upper and lower tape conveyors 27 and 22. After the entire sheet stack has exited cylinder 8, tongues 9 can be pivoted to facilitate the collection of an additional sheet stack. And, by pivoting shafts 37–40, the pressure exerted by the fast moving tapes on the sheet stack can be released and instead the slower moving tape conveyors 28 and 15 can be pressed against the sheet stack. Since shafts 37 and 38 as well as shafts 39 and 40 are relatively staggered respectively, the sheet stack to be deposited will be non-squared off in the form of an S curve. As a result the force with which the moving tapes grip the sheet stack between them is increased and the sheet stack itself is flexed during its movement which increases its stability. As a consequence of the corresponding pivoting of shafts 37–40 and that of the first and second cam discs mounted thereon in a given phase, the sheet stack increasingly loses contact with the fast moving tapes and increases its contact with the slower moving tapes and is slowed down as a result. The prescribed path is available for this deceleration process which is defined by the length between guide rollers 16 and 35 at the upstream end and guide rollers 26, 21 and 32, 36 at the downstream end. Pivoting of shafts 37–40 occurs in such a manner that the pressure of the relatively fast moving upper and lower tapes and the pressure of the relatively slower moving upper and lower tapes and the temporal duration of this pressure on the sheet stack, clamped between the opposing conveyors, are changed in accordance with the number of sheets to be collected by the collecting cylinder. A corresponding, true-to-phase rotating drive for shafts 37–40 is provided although not shown.

The tapes of the several tape conveyors are of elastic, preferably synthetic, material as typically provided for tape conveyors. The lateral spacing of the tape conveyors are such as to permit the tapes to bear against a sheet outside the printed area if the sheet has been printed during an earlier printing operation. And, since the cam discs for the faster moving tape conveyors have a different effective angular extent compared to the cam discs for the slower moving tapes, different operative times are required for the fast or the slower moving tapes. And, the extent of the angular pivoting of the cam discs depends on the number of sheets of the stack collected by the collecting cylinder. The fast moving tapes have preferably the same surface speed as the rotational speed of the collecting cylinder. The slower moving tapes have an operating speed which corresponds to the number of sheets to be deposited together in one sheet stack, such as a fourth or a fifth of the speed of the faster moving tapes. If desired, cam discs 48 can be omitted so that the sheet stacks to be deposited are intercepted by the slower moving tapes at the exit end of the tape conveyors.

Instead of a single depository 49, several depositories, such as three aligned behind one another, can be arranged in such a manner that sheet stacks to be deposited can optionally be channeled to one or the other of these depositories. It is therefore advantageous for the speed at which the sheets or sheet stacks are to be deposited to be the same at all deposit stations.

The inertia forces generated during the deceleration of the sheets are small in accordance with the present arrangement. Consequently, forces which could have undesirable effects on the operation of the entire delivery system are maintained as small as possible and, for all practical purposes, are non-existent.

Between the web cutting device and the collecting cylinder are lower tape conveyors 50 spaced apart laterally and opposing tape conveyors 27. Tapes 50 are wound about guide rollers 51, 52, 53 and 14, and are interdigitated with tapes 10 on roller 14.

What is claimed is:

1. Apparatus for delivering a succession of sheets along a horizontal path from a sheet cutting station to a sheet collecting cylinder means at which stacks of said sheets are formed, and for delivering said stacks along said path from said cylinder means to a sheet stack depository station, comprising a frame having spaced side walls, first and second laterally adjacent tape conveyor means mounted on said frame between said side walls, said first conveyor means comprising a pair of opposing upper and lower tape conveyors, and said second conveyor means comprising a pair of opposing upper and lower tape conveyors for delivering the stacks moving between the tapes of said pairs from said cylinder means to said depository station, said first pair of tapes moving at a predetermined speed, and said second pair of tapes moving at a speed less than said predetermined speed for delivering the stacks at selective speeds, said first pair of tapes and said second pair of tapes having substantially equal horizontal stack delivery paths, and means for selectively pressing together said tapes of said first pair and said tapes of said second pair to effect the delivery of said stacks at said predetermined speed or at less than said predetemined speed.

2. The apparatus according to claim 1, wherein said first and second conveyor means include conveyor rollers defining said horizontal stack delivery paths, said rollers being mounted between said side walls for rotation about fixed axes.

3. The apparatus according to claim 1, wherein said selective pressing means comprise pairs of cam discs respectively associated with said first and second pairs of tapes, said cam discs being mounted between said side walls for movement about fixed axes.

* * * * *